US011371296B2

(12) United States Patent
McCormick

(10) Patent No.: US 11,371,296 B2
(45) Date of Patent: Jun. 28, 2022

(54) GUIDE DEVICE

(71) Applicant: PETROMAC IP LIMITED, Hamilton (NZ)

(72) Inventor: Stephen Peter McCormick, Hamilton (NZ)

(73) Assignee: PETROMAC IP LIMITED, Auckland (NZ)

( * ) Notice: Subject to any disclaimer, the term of this patent is extended or adjusted under 35 U.S.C. 154(b) by 0 days.

(21) Appl. No.: 16/958,900

(22) PCT Filed: Jan. 4, 2019

(86) PCT No.: PCT/NZ2019/050001
§ 371 (c)(1),
(2) Date: Jun. 29, 2020

(87) PCT Pub. No.: WO2019/135683
PCT Pub. Date: Jul. 11, 2019

(65) Prior Publication Data

US 2020/0340308 A1 Oct. 29, 2020

(30) Foreign Application Priority Data

Jan. 5, 2018 (NZ) ..... 738892

(51) Int. Cl.
*E21B 17/02* (2006.01)
*E21B 17/10* (2006.01)

(52) U.S. Cl.
CPC ..... *E21B 17/1021* (2013.01); *E21B 17/02* (2013.01)

(58) Field of Classification Search
CPC ..... E21B 17/1021; E21B 17/02
See application file for complete search history.

(56) References Cited

U.S. PATENT DOCUMENTS

| | | | | |
|---|---|---|---|---|
| 2,710,170 | A | 6/1955 | Livingston et al. | |
| 4,474,235 | A | 10/1984 | Coshow | |
| 5,415,238 | A | 5/1995 | Nice | |
| 6,002,257 | A | 12/1999 | Thomas et al. | |
| 2009/0145596 | A1 | 6/2009 | Hansen et al. | |
| 2012/0061098 | A1 | 3/2012 | Hall | |
| 2014/0238659 | A1 | 8/2014 | Wheater et al. | |
| 2015/0152704 | A1 | 6/2015 | Tunget | |
| 2015/0337604 | A1* | 11/2015 | Archuleta | E21B 47/13 166/65.1 |
| 2016/0245040 | A1* | 8/2016 | Nelson | E21B 33/03 |

FOREIGN PATENT DOCUMENTS

| | | |
|---|---|---|
| GB | 2483227 B | 3/2012 |
| RU | 2055974 C1 | 3/1996 |

* cited by examiner

*Primary Examiner* — Taras P Bemko
(74) *Attorney, Agent, or Firm* — Dann, Dorfman, Herrell and Skillman, P.C.

(57) ABSTRACT

A guide device for a tool string to guide the tool string down a wellbore, the guide device comprising: a coupling to connect the guide device to an end of a tool string, a mandrel and a tip at a leading end of the mandrel, a centralising device supported by the mandrel, and a joint (a flexible joint or articulation joint) between the mandrel and the coupling allowing angular displacement of the mandrel relative to the tool string so that the tip can displace from a longitudinal axis of the tool string.

16 Claims, 9 Drawing Sheets

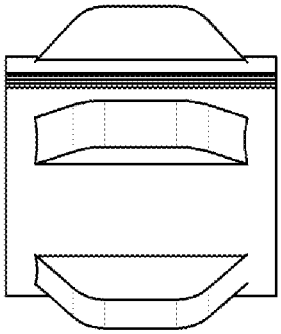
Fig 9A
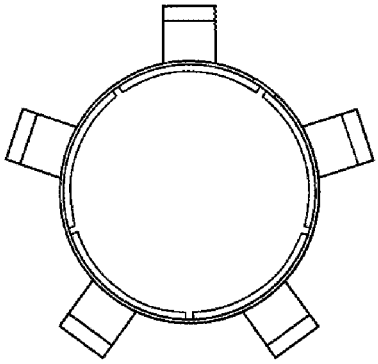
Fig 9B
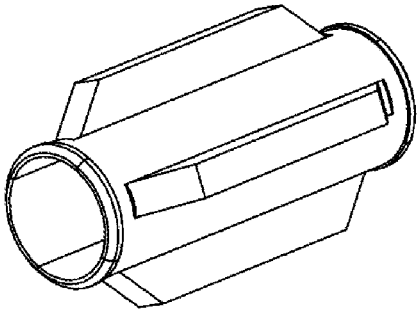
Fig 9C
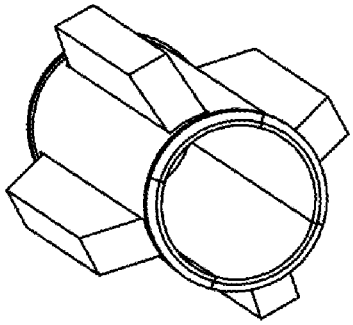

GUIDE DEVICE

TECHNICAL FIELD

This invention relates to apparatus for use in guiding sensor equipment, and in particular to apparatus for use in guiding sensor equipment in wireline logging applications.

BACKGROUND ART

Hydrocarbon exploration and development activities rely on information derived from sensors which capture data relating to the geological properties of an area under exploration. One approach used to acquire this data is through wireline logging. Wireline logging is typically performed in a wellbore immediately after a new section of hole has been drilled. These wellbores are drilled to a target depth covering a zone of interest, typically between 1000-5000 meters deep. A sensor package, also known as a "logging tool" or "tool-string" is then lowered into the wellbore and descends under gravity to the target depth of the well. The logging tool is lowered on a wireline—being a collection of electrical communication wires which are sheathed in a steel cable connected to the logging tool. Once the logging tool reaches the target depth it is then drawn back up through the wellbore at a controlled rate of ascent, with the sensors in the logging tool operating to generate and capture geological and petrophysical data.

There is a wide range of logging tools which are designed to measure various physical properties of the rocks and fluids contained within the rocks. The logging tools include transducers and sensors to measure properties such as electrical resistance, gamma-ray density, speed of sound and so forth. The individual logging tools are often combinable and are typically connected together to form a logging tool-string. These instruments are relatively specialised sensors, which in some cases need to be electrically isolated or located remote from metallic objects which are a source of noise in the data generated. Some sensors are designed to make close contact with the borehole wall during data acquisition whilst others are ideally centred in the wellbore for optimal results. These requirements need to be accommodated with any device that is attached to the tool-string.

The drilling of wells and the wireline logging operation is an expensive undertaking. This is primarily due to the capital costs of the drilling equipment and the specialised nature of the wireline logging systems. It is important for these activities to be undertaken and completed as promptly as possible to minimise these costs. Delays in deploying a wireline logging tool are to be avoided wherever possible.

One cause of such delays is the difficulties in lowering wireline logging tools down to the target depth of the wellbore. As the logging tool is lowered by cable down the wellbore by gravity alone, an operator at the top of the well has very little control of the descent of the logging tool.

Logging tools can become held up on rock ledges in the wellbore. These ledges often form on the interface with hard rock where overlying softer formations are washed out during drilling. Hard rocks tend to be in-gauge or the same size as the drilling bit. Washed out rock can occur in softer formations sometimes from poor drilling practise. Some formations, such as hydroscopic clays, tend to swell and slough into the wellbore causing large washouts. Washout enlargement can be caused by excessive bit jet velocity, soft or unconsolidated formations, in-situ rock stresses, mechanical damage by drilling assembly, swelling or weakening of shale as it contacts fresh water. Generally, washouts become more severe with time. Other rocks, such as coal measures, are friable and will breakout into the wellbore forming large caverns. Ledges often form below the casing shoe (bottom of hole section that is lined with pipe cemented to the wellbore). This region is often over-gauge due to the rat-hole from the previous drilling section and increased turbulence during open hole drilling.

FIG. 1 illustrates a logging tool string 1 located within a washout section 5 of a wellbore 10. The string is held up on a ledge 11 formed at an interface between a hard rock formation 12 and a softer formation 13 in which the washout has occurred. Formations or rock layers are often horizontal. Consequently, when a soft formation overlays a hard formation a ledge is formed perpendicular to the wellbore in a near vertical well. During descent the logging tool will slide along a side of the wellbore and come to a dead stop at the ledge 11. In such a situation the ledge is virtually impossible to pass. Once a logging tool is held up on a ledge an operator may spend a significant amount of time reeling the cable and tool-string in an attempt to move it past the obstruction. Typically each attempt is more aggressive than the last and damage to the logging tool may occur. If unable to pass the ledge the only options left are to either cancel the logging operation or re-enter the well with a drilling assembly in order to remove the worst of the ledge. There is no guarantee that the subsequent logging operation will be successful. Often the decision must be made to either cancel logging operations or attempt other methods, both of which are expensive options.

The chances of a wireline logging tools getting held up or being impeded is also significantly increased with deviated wells. Multiple deviated wells are usually drilled from a single surface location to allow a large area of interest to be explored. Deviated wells do not run straight vertically downwards and instead extend downward at an angle. As wireline logging tools are run down a wellbore with a cable under the action of gravity, the tool-string will traverse the low side or bottom of the wellbore wall and immediately encounter any obstructions on the wellbore wall as it travels downwards to the target depth. These obstructions are usually ledges. Furthermore, logging tools are typically more flexible than drilling pipe, and are often held up in a washout that commonly forms below a casing shoe. As illustrated in FIG. 2, the tool string 1 flexes under gravity into the larger washout 5 formed below the casing shoe 15 of the casing 14, resulting in the tip of the tool 1 hitting a ledge 11 at the far side of the washout 5.

Attempts have been made to address the issue of holdup on ledges with a number of prior art "hole finding" devices. For example U.S. Pat. No. 4,474,235 (Coshow) and US patent application US 20120061098 (Wireline Engineering) describe systems for wireline hole finding devices which rely on one or more rollers located at the nose. The nose is the leading end of the holefinder located at the bottom of the tool-string during descent of the wellbore. These rollers are arranged to allow the nose of the tool-string to roll into, and then up and over, ledges and obstructions in a wellbore. The roller type of holefinder will roll over an obstruction provided the height of the "step" ledge is lower than the wheel radius. These prior art holefinders are relatively complicated and must be appropriately designed and maintained to withstand the hostile wellbore environment. The wheels used in these systems often jam, making the hole finder ineffective. These designs are also relatively heavy and rigid. Any impact forces acting on the hole finder are transmitted into the tool-string, potentially causing damage to the sensors. The components of these holefinders are made from metal and not drillable. Any loss of components will likely result in significant extra costs, particularly if the Oil Company intends to deepen the wellbore.

Other prior art "hole finding" devices have a nose which can deflect on impact with an obstruction. For example UK patent application GB2483227 has a connection which, when subjected to large compressive force, can bend. Another example of this type of holefinder is U.S. Pat. No. 6,002,257 which consists of a cone shaped, flexible rubber device that can deflect under load. The flexible holefinder bends on contact with the ledge. With both these devices there is no control on orientation of the deflection which is aptly depicted in FIG. 7 and FIG. 8 of U.S. Pat. No. 6,002,257. If the flexible holefinder bends in the desired direction it will help the logging tool to navigate past the obstruction. These hole finders work by running into an obstruction (e.g. a ledge) and use the force generated at impact to cause deflection of the nose section. As these devices have no control of the direction of deflection of the nose section, the big drawback with these types of holefinders is they are just as likely to droop into a washout as they are to climb over a ledge, thereby further impeding descent of the logging tool.

Another approach used in the design of hole finding devices is disclosed in US patent application US 20090145596. This patent specification describes an alternative hole finding system employed outside of wireline applications where a conduit, tubing or pipe is attached to the sensor tool in order to push it down the wellbore. This specification discloses a relatively complicated system which requires a surface operator to actively adjust the orientation of a nose assembly mounted at the bottom of the tool. The specification also discloses that this device requires a range of sensors that are used to detect sensor tool movement, and specifically if the sensor tool is held up. This form of hole finding system is again relatively heavy and complex. Furthermore, a dedicated operator is also required to monitor the progress of the sensor tool to actively adjust the orientation and angle of attack of the adjustable nose assembly when the sensors detect that the sensor device is held up as it moves down the wellbore.

All above mentioned prior art devices work by running into a ledge, losing downward inertia, and then deflecting or rolling over the obstruction.

It would therefore be of advantage to have an improved guide device which addressed any or all of the above issues, or at least provided an alternative choice. In particular, it would be of advantage to have an improved guide device that avoids impacts with obstacles and thereby preserves the downward momentum of the logging tool-string during descent. It would also be of advantage to have an improved guide device that did not require monitoring and active manipulation as the logging tool descends the wellbore. It would also be an advantage to have a holefinder device with a nose tip that that was positioned near or above the centre of the wellbore. It would be an advantage to have a holefinder device where the nose was orientated to extend at an angle upwards from the centreline of the tool string, regardless of the rotational position of the tool string about the centreline of the tool string as it descends in the wellbore. An improved guide device formed from a minimum number of metallic components, which is easy to maintain and manufacture and which is lightweight and simple would be of advantage over the prior art. Furthermore it would also be of advantage to have an improved guide device which, if lost in an exploration well, could be drilled through to remove it as an obstruction.

The reference to any prior art in the specification is not, and should not be taken as, an acknowledgement or any form of suggestion that the prior art forms part of the common general knowledge in any country.

DISCLOSURE OF INVENTION

According to one aspect of the present invention there is provided a guide device for a tool string to guide the tool string down a well bore, the guide device comprising:

- a coupling to connect the guide device to an end of a tool string,
- a mandrel and a tip at a leading end of the mandrel,
- a centralising device attached to the mandrel, and
- a joint (a flexible joint or articulation joint) between the mandrel and the coupling allowing angular displacement of the mandrel (tip) relative to the tool string so that the tip can displace from a longitudinal axis of the tool string.

Preferably the joint allows for angular displacement (articulation) of the mandrel in any direction. Alternatively, the joint is hinge joint to allow for pivoting of the mandrel relative to the tool string so that the tip can displace vertically from the longitudinal axis of the tool string.

Preferably the joint allows continuous angular displacement of the mandrel so that the tip can displace from the longitudinal axis of the tool string freely at any time.

Preferably the joint provides a maximum angle of displacement (angle of inclination) between the longitudinal axis of the mandrel and the tool string of 5 degrees, or 10 degrees, or 15 degrees, or 20 degrees, or 25 degrees, or 30 degrees.

In some embodiments, the joint substantially prevents relative rotation between the mandrel and the tool string. Alternatively, the joint allows for relative rotation between the mandrel and the tool string.

Preferably the joint permanently transmits axial loads

In some embodiments, the joint is biased a central position with the longitudinal axes of the mandrel and tool string aligned.

The joint may be a universal joint or a ball and socket joint, or may comprise an elastomeric member, or a swivel joint in combination with a hinge.

Preferably the mandrel is lightweight.

In some embodiments, the mandrel is a hollow member, preferably the hollow member is tubular, preferably the hollow member is lightweight, preferably the hollow member is stiff, preferably the hollow member is strong. In some embodiments, the hollow member is made from carbon fibre, for example a carbon figure tube or spar.

In some embodiments, the mandrel is positively buoyant or has neutral buoyancy in drilling mud. Alternatively, the mandrel is slightly negatively buoyant.

In some embodiments, the centralising device is a bow-spring centraliser and the mandrel weighs less than a maximum weight that the bow spring centraliser can support when immersed in well bore fluid.

In some embodiments, the mandrel weighs less than 15 kg when immersed in well bore fluid with a density of at least 1.3 g/cc. Alternatively, the mandrel weighs less than 10 kg when immersed in well bore fluid with a density of at least 1.3 g/cc. Alternatively, the mandrel weighs less than 5 kg when immersed in well bore fluid with a density of at least 1.3 g/cc.

The mandrel may be constructed from a material with a density of less than 3 g/cc, and/or the mandrel may have an average density of less than 3 g/cc.

Preferably the centraliser is located on the mandrel nearer to the tip than the flexible joint.

Preferably the centraliser is located at or near to the tip end of the mandrel.

Preferably the centraliser is mountable to the mandrel at a plurality of longitudinal positions.

Preferably, the longitudinal position of the centralising device is configurable to set the tip of the device near to or above the centreline of the wellbore for a range of wellbore diameters.

Preferably, the centralising device positions the tip near to or above (above being with respect to a horizontal or deviated wellbore) a centreline of the wellbore.

Preferably the centraliser is rotationally mounted to the mandrel.

Preferably the centraliser has sprung standoffs.

Preferably the centraliser has a minimum diameter less than the diameter of a gauge section of the well bore (the drill bit diameter).

Preferably the centraliser has a minimum diameter of about 1-inch less than the diameter of a gauge section of the well bore (the drill bit diameter).

The outer diameter of the centraliser may be variable.

The centraliser may be a bow-spring centraliser, and preferably comprises at least 3 bow springs. Preferably the bow springs are spaced equi-distant apart around a circumference of the mandrel.

Alternatively, the centraliser has fixed stand offs. Preferably the centraliser has an outer diameter less than the diameter of a gauge section of the well bore (for example about 1-inch less than the diameter of a gauge section of the well bore.

Preferably the device is without wheels attached to the mandrel.

Preferably any one or more of the coupling, the mandrel, the tip, the centralising device and the joint is made from a drillable material.

According to another aspect of the present invention there is provided a tool string and a guide device as described above attached to the tool string. The tool string may be provided without wheels, rollers, skids or other devices used to carry the tool string down the wellbore, and/or without an orientation device used to orient the tool string in a particular angular orientation within the wellbore.

The invention may also be said broadly to consist in the parts, elements and features referred to or indicated in the specification of the application, individually or collectively, in any or all combinations of two or more of said parts, elements or features, and where specific integers are mentioned herein which have known equivalents in the art to which the invention relates, such known equivalents are deemed to be incorporated herein as if individually set forth.

Further aspects of the invention, which should be considered in all its novel aspects, will become apparent from the following description given by way of example of possible embodiments of the invention.

BRIEF DESCRIPTION OF THE DRAWINGS

An example embodiment of the invention is now discussed with reference to the drawings in which:

FIG. 8A shows a bow-spring centraliser comprising six bow springs, and FIGS. 8B and 8C show spring energised articulated arm centralisers.

FIGS. 9A to 9C illustrate a multiple fixed fin centralisers. FIG. 9A is a side view and FIG. 9B is an end view of a five fin centraliser. FIG. 9C is a perspective type view of a four fin centraliser.

BEST MODES FOR CARRYING OUT THE INVENTION

Figure 3:
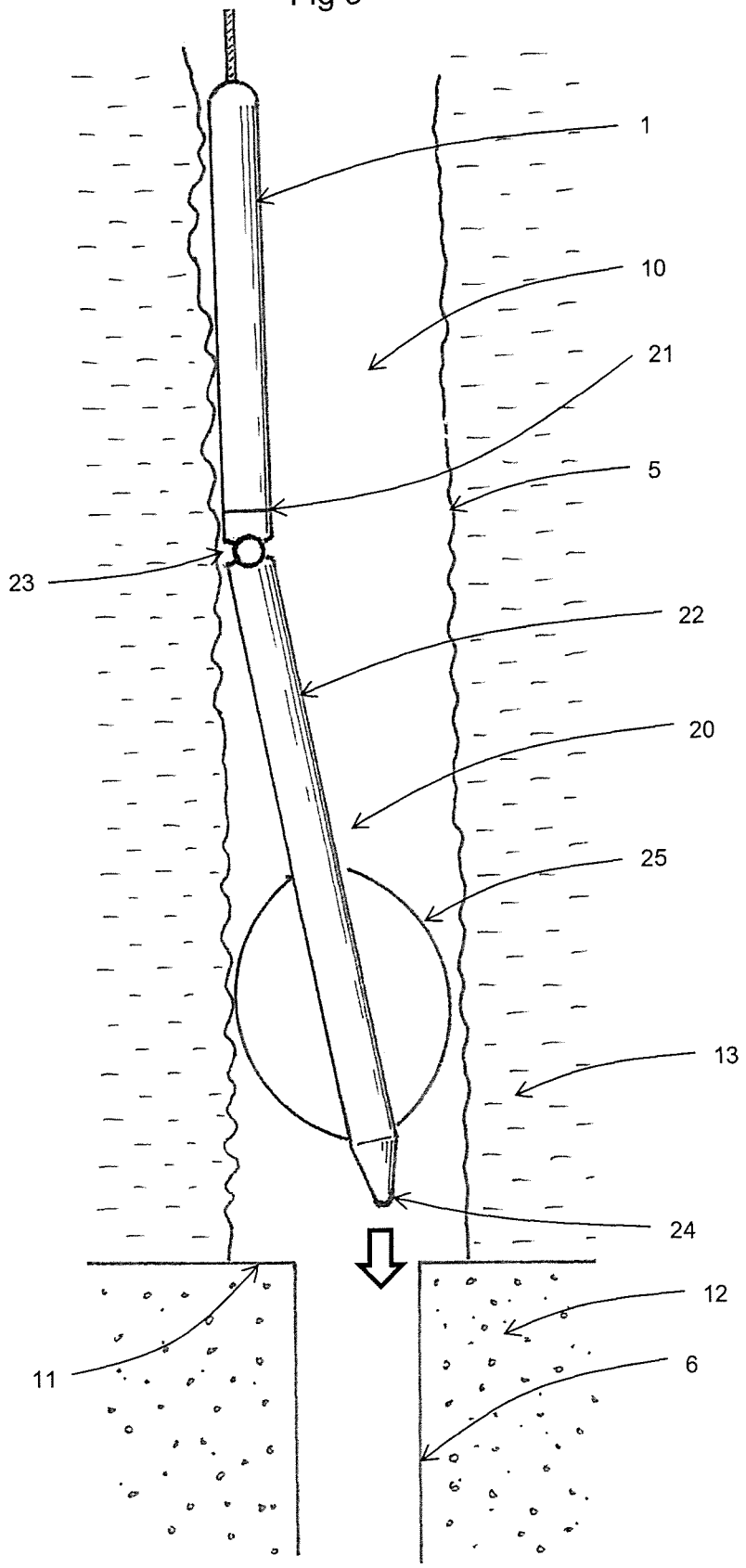
FIG. 3 illustrates a logging tool guided down a vertical wellbore by a guide device according to an embodiment of the present invention. The guide device is positioned within a washout section of the wellbore.
Figure 4:
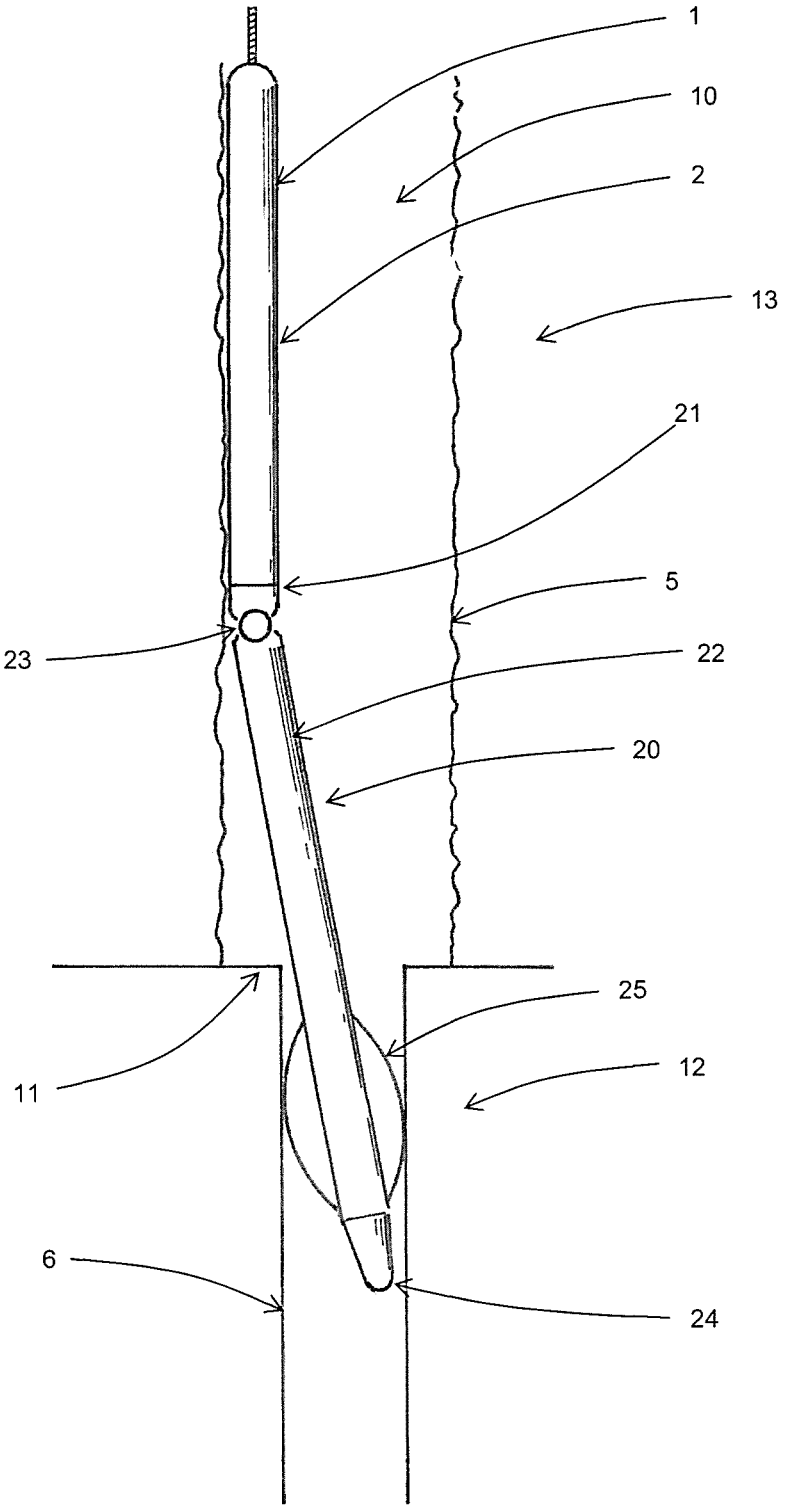
FIG. 4 illustrates the logging tool and guide device of FIG. 3 located further down the wellbore, with the guide device positioned within a gauge section of the wellbore (a section of the wellbore that is the same size as the drilling bit used to drill the well).

FIGS. 3 and 4 illustrate a guide device 20 coupled to an elongated sensor assembly 1 (herein a sensor package, sensor assembly, logging tool or tool string). The guide device operates to guide the tool string down a wellbore. The illustrated wellbore 10 is vertical and has a gauge section 6, which is a section drilled in a hard rock formation having essentially the same size bore as the drill bit that drilled the wellbore. The wellbore also has a washout section 5, as described in the above background section. In FIG. 3, the tool string 1 and guide device 20 have descended to a point or elevation in the wellbore 10 where the guide device 20 is located within the washout section.

The guide device 20 comprises a coupling 21 to connect the guide device to the tool string 1. The guide device is coupled to an end of the tool string by any suitable coupling as known in the art, for example via a screw thread. The coupling 21 is able to transmit axial loads, e.g. resists axial loads. In some embodiment the coupling prevents relative rotation between the tool string and the mandrel. Alternatively, the coupling may include a swivel device to allow for relative rotation between the mandrel and the tool string.

The guide device 20 comprises an elongate body or mandrel section 22 (herein a mandrel). The mandrel 22 is many times longer than it is wide, e.g. its length is much greater than its diameter. Preferably the mandrel 22 is at least 1 metre long, for example 2 metres long or 2 to 3 metres long. The mandrel is stiff to resist bending. The mandrel is capable of withstanding high axial loads, for example in the order of 20,000 pounds. Preferably the mandrel is lightweight. For example, the mandrel may be slightly buoyant or has neutral buoyancy in drilling mud. A suitable material for the mandrel is carbon fibre composite or glass reinforced plastic having a density of about 1.5 g/cc, or other suitable lightweight engineering plastic or composite. The lightweight material may have a density of less than 3 g/cc. Preferably the mandrel is a hollow member. In some embodiments, the hollow member is made from a carbon fibre composite or glass reinforced plastic. Preferably the hollow member is tubular, e.g. the mandrel is preferably a hollow spar or pipe. Alternatively, the mandrel may be solid, i.e. a solid rod or bar. A solid mandrel can be buoyant if constructed of light weight material.

Positive or neutral buoyancy in drilling mud can also be achieved by manufacturing the mandrel from a heavier material such as a metal, and with an interior of the hollow spar/mandrel sealed from the ambient environment so that the mandrel is filled with air or other gas.

Alternatively, the mandrel could have a thin metal wall or wall made from lightweight material and that allows drilling mud inside the mandrel. In such an embodiment, the mandrel may be slightly negatively buoyant.

Positive buoyancy is achieved by displacing a weight of mud that is more than the weight of the mandrel, regardless of the material used to make the mandrel. Thus the 'average density' of the mandrel is equal to the weight of the mandrel divided by the overall volume of the mandrel, whether the mandrel is made from a heavy material with an interior of the mandrel sealed, or made from a lightweight material with the interior open to ambient. Preferably the average density of the mandrel is similar to or may be less than the density of the drilling mud. In some embodiments the average density of the mandrel may be varied, to match a particular drilling mud density for a particular well operation. For example, weight (e.g. metal blocks) may be added to an interior or exterior of the mandrel, or the sealed internal volume of the mandrel may be varied.

Preferably the device comprises a cone shaped tip 24 at the distal or downward/front end of the mandrel 22.

The guide device comprises a flexible joint (articulation joint) 23 located between the coupling 21 and the mandrel 22. The flexible joint allows the longitudinal axis of the mandrel to incline relative to the longitudinal axis of the tool string, so that a tip 24 of the guide device can displace from a longitudinal axis of the tool string. In other words, the mandrel is articulated to the tool string by the flexible joint 23. For example, the joint 23 may be a universal joint or a ball and socket joint. The flexible joint may also be or comprise a rubber/elastomeric member, such as a rubber block or member that is capable of elastic deformation to allow articulation of the mandrel with respect to the tool string (e.g. via elastic bending of the elastomeric block).

Preferably the mandrel 22 is permanently articulated to the tool string, at least during use. For example, the flexible joint 23 is a permanent ball and socket joint or universal joint, or as stated above an elastomeric block, or any other known means to allow the longitudinal axis of the mandrel to incline relative to the longitudinal axis of the tool string in any angular direction. Being permanently articulated, the tip 24 of the guide device may displace from the longitudinal axis of the tool string freely at any time (e.g. continuously articulated) during deployment down the wellbore. The flexible joint 23 allows the mandrel to articulate from the tool string without fixing against the angular displacement of the mandrel. Preferably the flexible joint allows for the mandrel to articular in any direction so that the tip of the guide device can be displaced from the longitudinal axis of the tool string in any lateral direction.

Unless the context suggests otherwise, angular movement or displacement of the mandrel 22 relative to the tool string 1 means inclination of the mandrel 22 relative to the tool string so that an angle is presented between the longitudinal axis of the mandrel and the longitudinal axis of the tool string, to allow the tip 24 of the guide device to displace from the longitudinal axis of the tool string. Preferably the flexible joint 23 allows for a maximum angle of inclination between the longitudinal axes of the mandrel and the tool string of 10 degrees, or 15 degrees, or 20 degrees, or 25 degrees, or 30 degrees. Angular displacement of the mandrel is limited to the maximum angle of displacement (inclination). Angular displacement or articulation is preferably in any direction, i.e. in an end view the tip can move to scribe a circular path.

In some embodiments the flexible joint is biased to an inline position with the mandrel in line with the tool string when no lateral force is provided to the mandrel. For example, the joint comprises spring elements to bias the joint to a central neutral position with the longitudinal axes of the mandrel and tool string aligned. In such embodiments with a biased central position, preferably the joint may be deflected away from the central position by a relatively small lateral force applied to a centraliser (described below) carried on the mandrel, for example in the order of less than 100 pounds, or less than 30 pounds, or less than 10 pound force. An elastomeric block type joint is naturally biased to a central undeflected position.

The coupling 21 and flexible joint 23 may be formed as a single assembly, for example an assembly that couples the guide device to the tool string and provides for articulated movement of the mandrel relative to the tool string. In some embodiments, the coupling and flexible joint may comprise a first half connected to the mandrel and a second half adapted to connect to the tool string, and with an articulation mechanism between the first and second halves, e.g. a ball and socket wherein the ball or socket is connected to the mandrel and the other one of the ball and socket comprising an interface (e.g. screw thread) for connection to the tool string.

The flexible joint 23 is preferably able to transmit axial loads, e.g. resist axial loads, ie can transmit, not absorb, axial loads. In other words, the joint prevents significant relative axial movement between the mandrel and the tool string, ie the joint prevents the mandrel moving along a longitudinal axis relative to the tool string. Preferably the flexible joint permanently transmits axial loads. Preferably the flexible joint can transmit high axial loads, e.g. in the order of 20,000 pounds. The flexible joint may prevent or restrict relative rotation between the tool string and the mandrel. For example, a universal joint or rubber connection allows angular displacement of the mandrel from the longitudinal axis of the tool-string, in any direction. Alternatively, the flexible joint may also allow for relative rotation between the mandrel and the tool string in addition to providing angular displacement allowing the tip of the guide device to displace laterally from the tool string. For example, a ball and socket joint that allows rotation between the ball and socket on the axis of the mandrel. The flexible joint may comprise a universal joint and a swivel joint to allow relative rotation, similar to a ball and socket joint. The flexible joint may comprise of an element allowing rotation, e.g. a swivel joint, and a pin connection perpendicular to the rotational axis of the element allowing rotation, e.g. a hinge, allowing angular displacement, the combination of the swivel and hinge allowing angular displacement in any direction. The joint may comprise a hinge allowing for pivoting of the mandrel relative to the tool string so that the tip can displace vertically upwards from the longitudinal axis of the tool string in a deviated wellbore. In such an embodiment the tool string must be correctly orientated by an orientation device, so that the mandrel can pivot from the tool string in the correct direction, ie upwards in a deviated well. The hinge may allow for pivoting of the mandrel away from the longitudinal axis of the toolstring in a single direction, so that the mandrel can pivot away from the longitudinal axis in an upwards direction only.

The guide device 20 comprises a centralising device 25 (herein a centraliser). The centraliser is carried on the mandrel. Preferably the centraliser fits over the mandrel, i.e. may be slid onto the mandrel during assembly. In FIGS. 3 and 4 the centraliser is a bow-spring type centraliser, which are known in the art. A bow-spring centraliser is a device comprising bow shaped or curved springs. The curved springs (leaf springs) are arranged parallel to the longitudinal axis of the mandrel and are spaced apart circumferentially around the mandrel to form a barrel shape. The curved springs are linked to central collars at each end. When the bow-spring centraliser is run in a wellbore that is a smaller diameter than an outer diameter of the centraliser with the bow-springs un-deflected, the bow-springs are flattened or deflected elastically, and the central collars are pushed longitudinally apart along the mandrel. The flattened springs exert a centring force on the mandrel via the central collars. The centering force of a bow-spring centraliser is a function of bow-spring material, dimensions and amount of deflection.

Figure 8A:
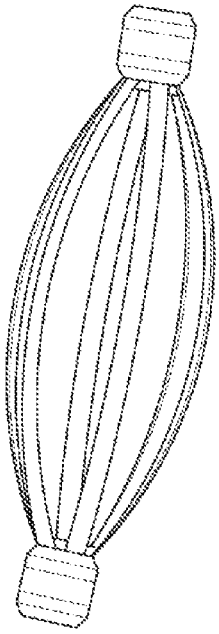
FIGS. 8A, 8B and 8C illustrate centraliser devices.
Figure 8B:
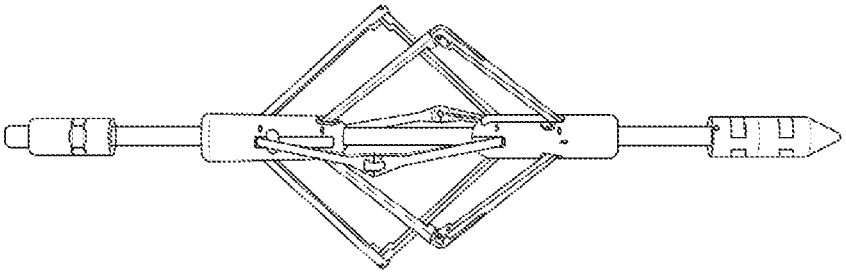
Figure 8C:
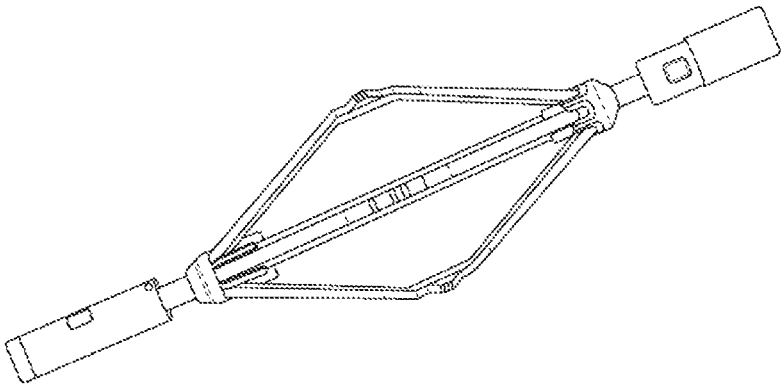

The centraliser 25 is preferably a multiple arm bow-spring centraliser, for example preferably the centraliser has three or more bow-springs. The bow springs are preferably equispaced about the longitudinal axis of the mandrel. Alternative centraliser devices may be provided, for example a multiple fixed fin centraliser (a fixed centraliser) comprising at least three fins, a spring energised articulated arm centraliser, or other centralisers known in the art. For example, FIG. 8A shows a bow-spring centraliser comprising six bow springs, and FIGS. 8B and 8C show spring energised articulated arm centralisers. FIGS. 9A to 9C illustrate multiple fixed fin centralisers.

The centraliser is positioned on the mandrel at a location along the length of the mandrel to maintain the tip 24 of the guide device near to or above (above being with respect to a horizontal or deviated wellbore) the centreline of the wellbore. The lateral position of the tip 24 within the wellbore is dependent on the longitudinal position of the centraliser on the mandrel (e.g. the position between the flexible joint 23 and the tip 24) and the outer diameter (outer lateral dimension) of the centraliser 25. The closer the centraliser is to the flexible joint 23, the greater the displacement of the tip 24 from the longitudinal axis of the tool string 1. Preferably the centraliser is located nearer to the tip than the flexible joint to prevent the tip from engaging the high side of the wellbore. Preferably the centraliser can be positioned anywhere along the mandrel to allow the operator to configure the device to move past different ledge geometries. Preferably the centraliser is located at or near to the tip end of the mandrel. In some embodiments the centraliser may be mounted to the mandrel at a plurality of longitudinal positions so that the position of the centraliser on the mandrel can be chosen to set the guide device for a particular wellbore diameter, ledge geometry and tool string standoff. Tool string standoff is the distance of the logging tool from the wellbore wall when the tool string is carried on standoffs or centralisers. The device can therefore be configured to set the tip of the device near to or above the centreline of the wellbore for a range of wellbore diameters. Additionally or alternatively the amount of spring bias and/or maximum diameter of the sprung standoffs such as bow springs may be variable, to set the guide device up for a particular wellbore diameter and mud buoyancy (mud density).

The centraliser may be rotationally fixed to the mandrel, or may be mounted to the mandrel for rotation relative to the mandrel.

For a centraliser with sprung standoffs such as bow springs or spring energised articulated arms, preferably the centraliser has a minimum diameter less than the diameter of the bit size used to drill the wellbore. This means the sprung standoffs maintain contact with the wellbore wall when in a minimum or gauge diameter of the wellbore without presenting excessive force against the wellbore wall. In some embodiments, the minimum diameter of the centraliser is about 1-inch less than the minimum diameter or bit size of the wellbore. The maximum and/or minimum diameter of the centraliser may be set by mechanical stops restricting the length the centraliser can displace along the mandrel. In some embodiments the diameter of the sprung centraliser may be fixed at a diameter less than the gauge diameter of the wellbore, for example about 1-inch less than the wellbore gauge.

For fixed diameter centralisers, e.g. fixed fin centralisers, the centraliser has a diameter less than the bit size or gauge diameter of the wellbore, and preferably about 1 inch less than the bit size/gauge diameter.

For sprung standoff centralisers, the maximum diameter of the centraliser (e.g. when in an uncompressed state) and spring force of the standoffs present a relatively low lateral force against the wellbore wall when located in the gauge section 6 of the wellbore. For example, the centraliser maximum diameter and standoff spring force preferably provides a maximum force against the well bore wall of less than 100 pounds, or less than about 50 pounds, or about 20 pounds.

By choosing a suitable combination of centraliser diameter and centraliser longitudinal position relative to the flexible joint, the guide device is able to maintain the tip 24 of the guide device 20 at a position that is near to the centre of the wellbore, or above the centre of the wellbore with respect to the centreline of a horizontal/deviated wellbore. As illustrated in FIG. 3, when in a washout section of the wellbore, the centraliser is in a uncompressed configuration, or a configuration that is not fully compressed, and causes the flexible joint to deflect by contact with the wall of the washout section, so that the longitudinal axis of the mandrel is inclined to the longitudinal axis of the tool string to position the tip of the guide device laterally from the longitudinal axis of the tool string to be located near to the centre of the well bore. This allows the tip 24 of the guide device to locate and enter a smaller diameter section of the wellbore below a larger diameter section of the wellbore. The guide device can therefore find the path down the wellbore that the tool string will naturally follow. The lateral offset of the tip allows the guide device to ski over obstructions such as ledges within the wellbore and maintain momentum of the tool string as it travels down the wellbore. As the guide device enters the gauge section or smaller diameter section of the wellbore, the centraliser is compressed, as shown in FIG. 4. As the tool string continues to descend down the wellbore, as the tool string enters the small diameter section of the well bore the flexible joint straightens out so that the guide device and tool string align or the incline between the axes of the guide device and tool string reduce.

Example dimensions for a bow-spring centraliser guide device for a 8.5 inch well bore are a centraliser outside diameter of 20 inches in an uncompressed configuration, a minimum or fully compressed diameter of 7.5 inches, a mandrel length of 72 inches, with the centraliser located 60 inches from the flexible joint. A typical lateral force required to compress the centraliser to the fully compressed configuration is less than about 50 pounds.

Figure 5:
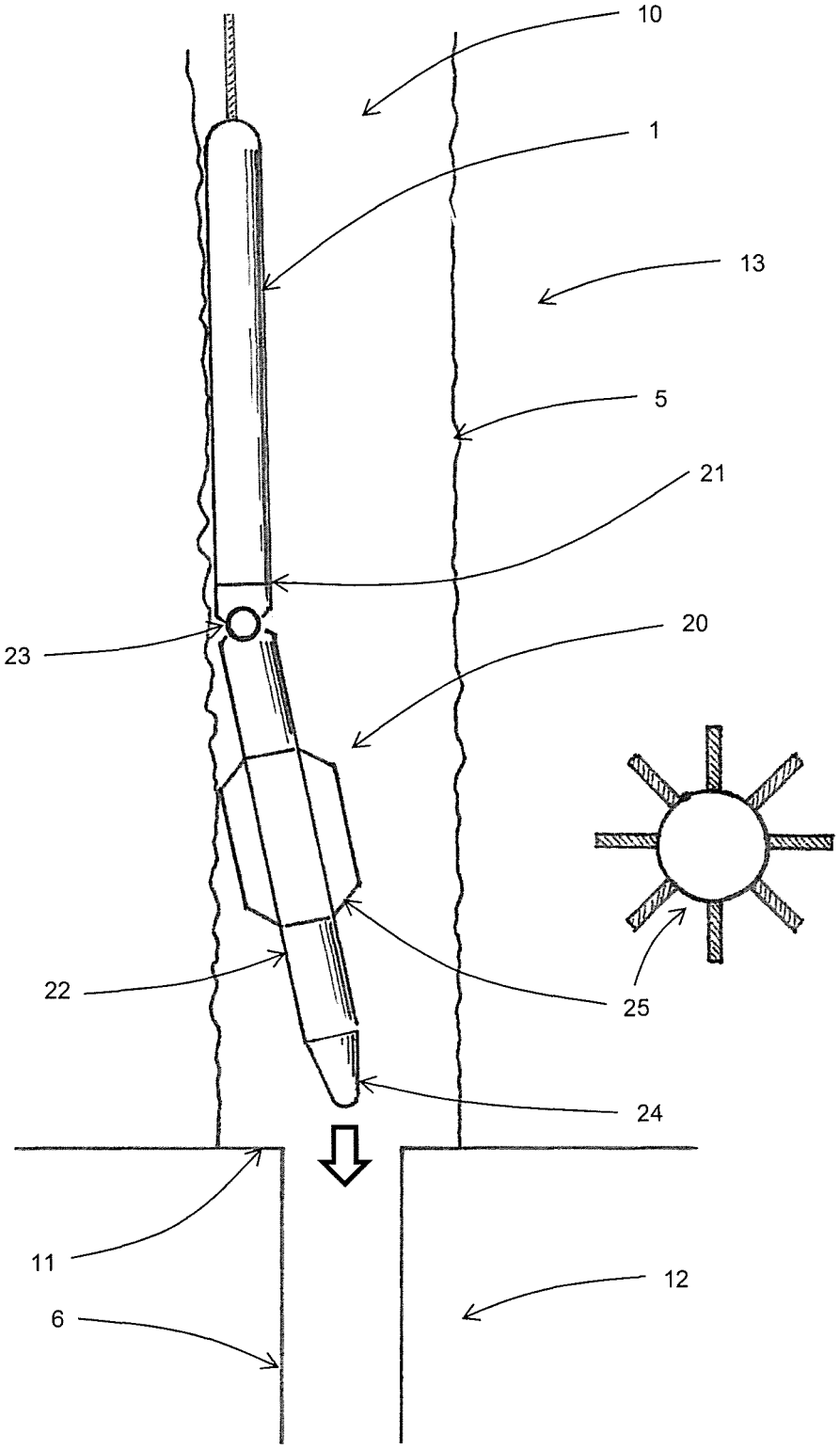
FIG. 5 illustrates a logging tool guided down a vertical wellbore by a guide device according to an alternative embodiment of the present invention. The guide device is positioned within a washout section of the wellbore.
Figure 6:
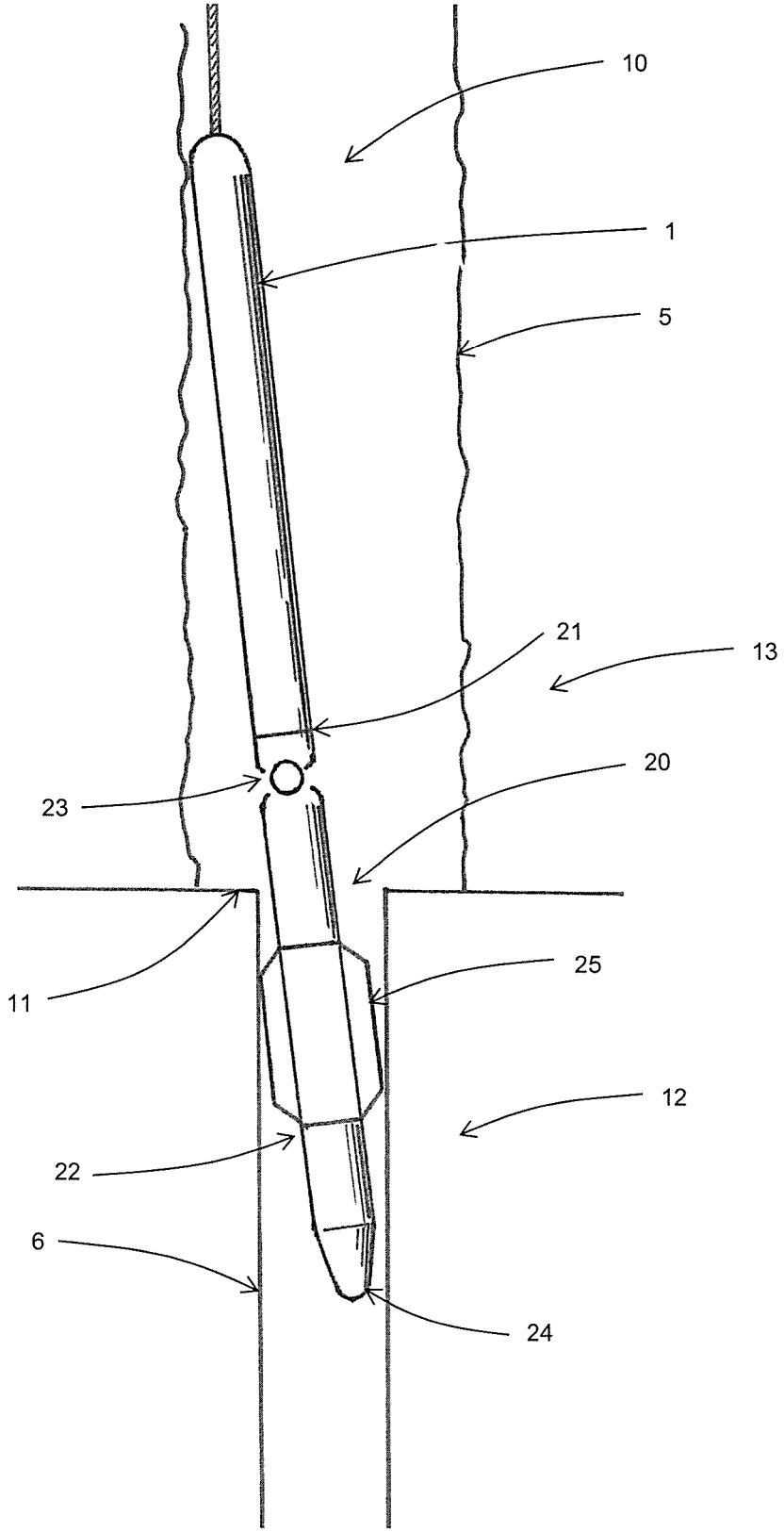
FIG. 6 illustrates the logging tool and guide device of FIG. 5 located further down the wellbore, with the guide device positioned within a gauge section of the wellbore.

FIGS. 5 and 6 illustrate an alternative guide device 20 comprising a fixed fin or fixed standoff centraliser 25. The guide device works in a similar way to the device of FIGS. 3 and 4. The diameter and location of the centraliser 25 ensures the tip 24 of the guide device 20 is located near to the centre of the wellbore, even when in a relatively large diameter section of the wellbore, as shown in FIG. 5. This allows the guide device to locate smaller diameter sections of the well bore below the larger diameter section. As the guide device enters the smaller diameter section of the wellbore, the tool string follows the guide device and the flexible joint straightens out, as shown in FIG. 6, to allow the tool string to continue to travel down the bore, avoiding an impact with a ledge 11 at a boundary between hard rock and soft rock formations. Example dimensions for a fixed fin centraliser guide device for a 8.5 inch well bore are a centraliser outside diameter of 7.5 inches, a mandrel length of 72 inches, with the centraliser located 48 inches from the flexible joint.

Figure 1:
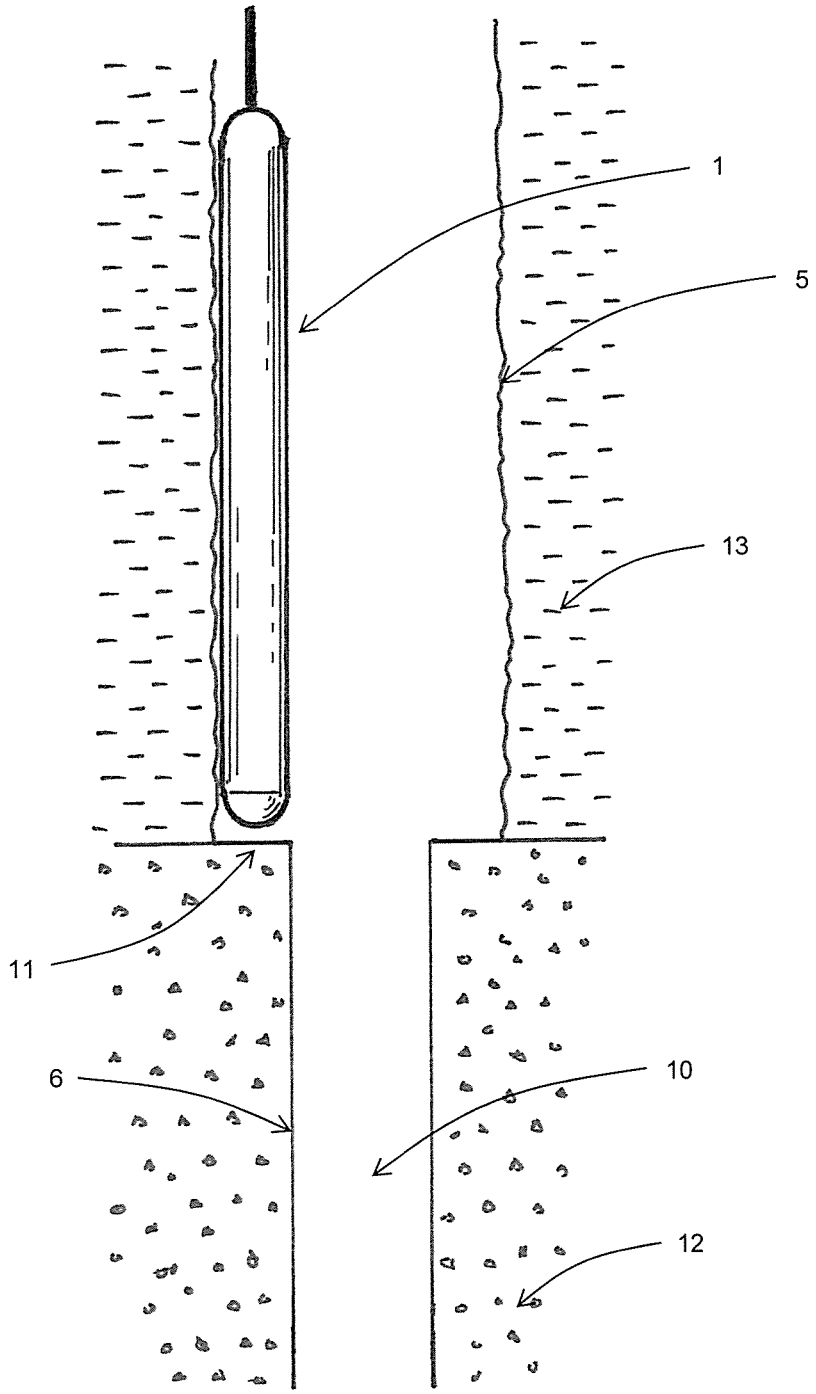
FIG. 1 illustrates a tool string held up on a ledge within a vertical wellbore.
Figure 2:
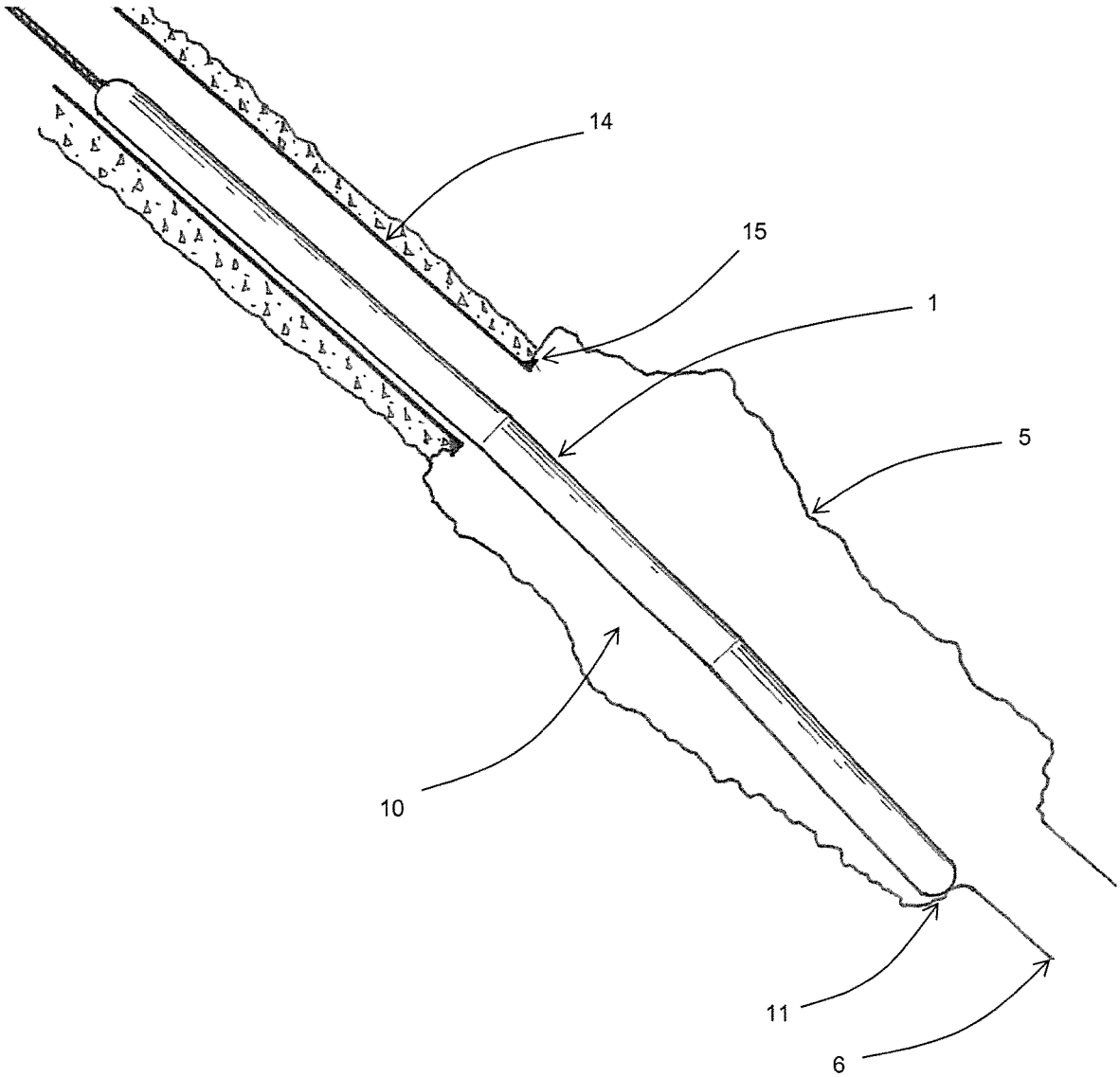
FIG. 2 illustrates a tool string held up on a ledge within a deviated wellbore.
Figure 7:
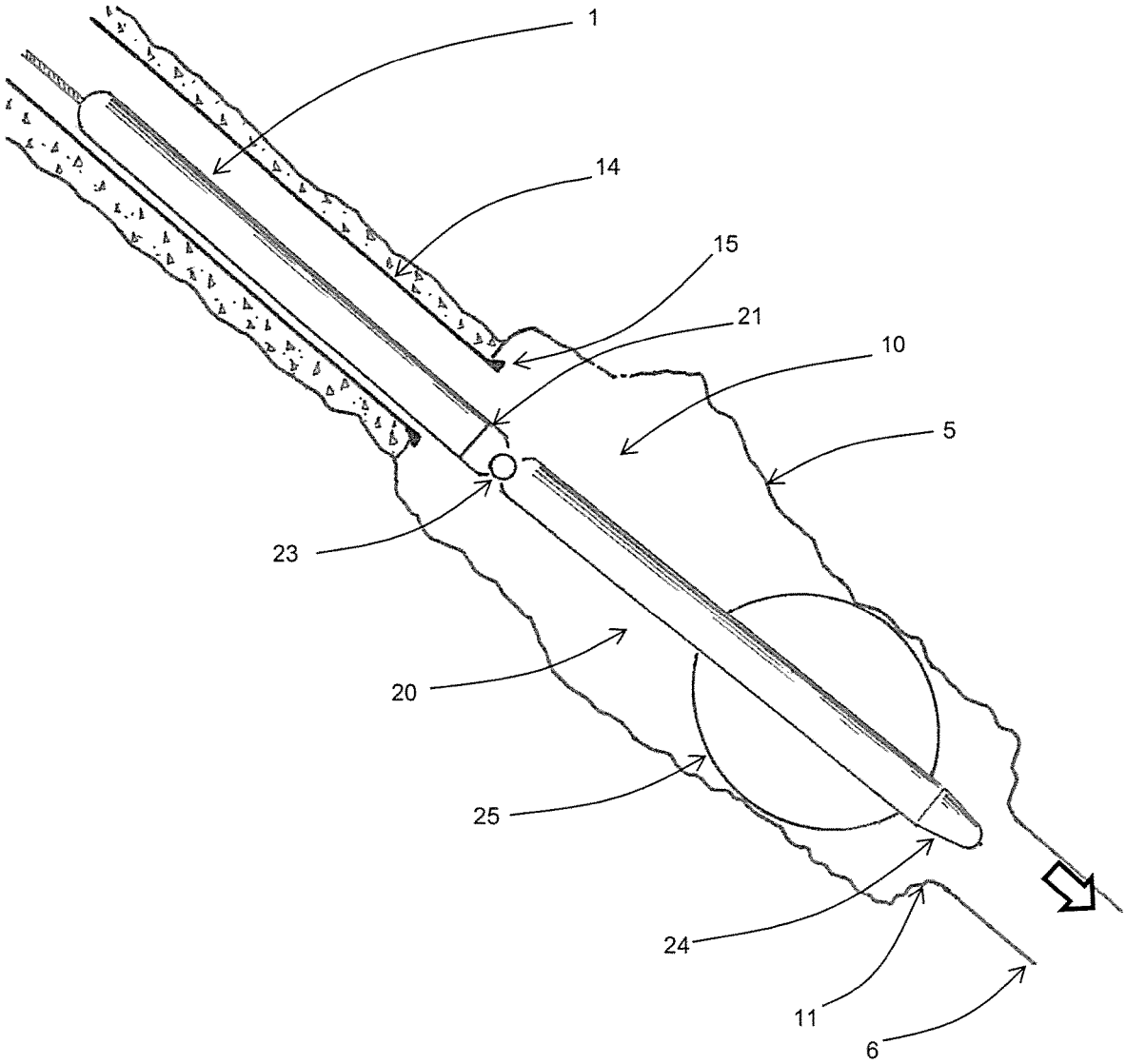
FIG. 7 illustrates the logging tool and guide device of FIG. 3 within a deviated wellbore, with the guide device positioned within a washout section of the wellbore.

FIGS. 3 to 6 show vertical well bores. The guide device 20 is particular useful in deviated wellbores to overcome droop or bending of the tool string as shown in FIG. 2 and described above in the background section. The diameter and position of the centraliser 25 from the flexible joint ensures the tip 24 of the device 20 is located near to or above the centreline of the wellbore, even in larger diameter sections of the wellbore, to allow the guide device to find a smaller diameter section below the washout or larger diameter section, as illustrated in FIG. 7. The position of the centraliser on the mandrel ensures the mandrel is inclined upwards from the flexible joint when the tool string and guide device are located in a larger bore section of the wellbore.

As stated above, preferably the mandrel is lightweight, and may be slightly buoyant or neutrally buoyant in drilling mud. This ensures that the weight of the mandrel is substantially negligent when in use. This is of particular benefit in deviated wellbores, as the guide device may be deflected relatively easily from a low side of the wellbore by the centraliser since the weight of the mandrel is insignificant. Preferably the lateral force required to deflect the flexible joint to incline the mandrel from the tool string is minimised. Preferably the guide device is without wheels or skids attached to the mandrel or centraliser or tip. Adding wheels increases weight of the device and the articulated part of the device should be as lightweight as possible.

As described above, in some embodiments the mandrel is positively buoyant in drilling mud (the mandrel floats in drilling mud). The buoyancy of the mandrel may also overcome the weight of the articulated components of the guide device, the components attached to or carried by the mandrel such as the tip 24 and the centraliser 25. By being positively buoyant the mandrel with centraliser can float off the low side of the wellbore wall in non-vertical wells. The centraliser not only acts against the low side of the wellbore to maintain the tip near to the centre of the wellbore, but can also act against the high side of the well bore where the mandrel has floated off the bottom of the well bore, to maintain the tip close to the centre of the well bore to locate a smaller diameter section below a larger diameter section.

Where the mandrel is positively buoyant in drilling mud, the mandrel can float and rise away from a low side of the well bore. Thus, in a deviated well bore and with the tool string located on a low side of the well bore, the mandrel can remain at an incline from the tool string and flexible joint by both the mandrel buoyancy and also the centraliser acting against the well bore wall.

Alternatively, in some embodiments the mandrel is negatively buoyant (the mandrel sinks in drilling mud) yet relatively lightweight so that the guide device 20 may be deflected relatively easily from a low side of the wellbore by the centraliser since the weight of the mandrel is insignificant. In a preferred embodiment of the present invention, the weight of the mandrel when immersed in drilling mud/ambient well bore fluid is less than a maximum force or weight that the centraliser can support. For example, where a bow spring centraliser can support a maximum weight of 15 kg, preferably the mandrel in well bore fluid weights less than 15 kg. An example mandrel is constructed from a thin wall steel tube that is open at both ends, such that the mandrel can be flooded/filled with well bore fluid. A suitable mandrel may be schedule-10 stainless steel pipe, which has an outside diameter of 88.9 mm and a wall thickness of 3 mm. A mandrel formed from schedule-10 stainless steel pipe with a length of 2.0 m has a weight of approximately 13 kg. When immersed in drilling mud with a density of 1.3 g/cc this example mandrel weighs less than 11 kg, thus is slightly negatively buoyant yet weighs less than the maximum weight a bow spring centraliser can support. Such a mandrel is therefore lightweight. Such an arrangement allows the mandrel to be easily deflected from the side of the well bore, to find the centre of a well bore as the tool strings traverses along the well bore from a washout or larger diameter section to a smaller diameter or gauge section.

In another example the mandrel is constructed of thick wall steel pipe that is sealed at both ends and able to resist the crushing force exerted in deep wells by the hydrostatic pressure of the well bore fluid. A suitable mandrel may be schedule-80 stainless steel pipe, which has an outside diameter of 88.9 mm and a wall thickness of 7.6 mm. A mandrel formed from schedule-80 stainless steel pipe with a length of 2.0 m has a weight of approximately 30 kg. When immersed in drilling mud with a density of 1.3 g/cc this example mandrel weighs approximately 14 kg, thus is slightly negatively buoyant yet weighs less than the maximum weight a bow spring centraliser can support. Such an arrangement allows the mandrel to be easily deflected from the side of the well bore, to find the centre of a well bore as the tool strings traverses along the well bore from a washout or larger diameter section to a smaller diameter or gauge section.

Lighter mandrels may also be possible weighing less than 5 kg in drilling mud, for example a 2 m length of aluminium pipe with an OD of 90 mm and wall thickness of 3.0 mm has a weight of approximately 4.4 kg. When immersed in drilling mud with a density of 1.3 g/cc this example mandrel weighs approximately 2.3 kg, thus is slightly negatively buoyant and can be easily supported by a bowspring centraliser device.

Alternatively, lighter mandrels may also be possible that weigh less than 2 kg in drilling mud, For example a hollow member made from a light weight material such as carbon fibre, kevlar or glass reinforced plastic composite material. Carbon fibre composite has a density of approximately 1.6 g/cc. A 2 m length carbon fibre composite hollow tube with an OD of 92.1 mm and wall thickness of 6 mm weighs 5.2 kg. In 1.3 g/cc drilling mud, the buoyant weight of this hollow tube is approximately 1 kg. Such a mandrel can be easily centered in the wellbore by a relatively light, low strength, bow-spring centraliser.

In preferred embodiments components of the guide device are manufactured from drillable materials. In an event where the guide device is lost down hole, the guide device may be drilled through in a subsequent drilling operation to enable rerunning a new tool string. As stated above, preferably the mandrel is formed from carbon fibre, glass reinforced plastic or other plastic or composite engineering material which not only has the benefit of being lightweight and strong as described above, but is also drillable. Furthermore, preferably the tip is made from a drillable material such as glass reinforced nylon. Where a fixed standoff centraliser is used, the centraliser may also be made from similar drillable materials. A drillable material is a material that is drillable by a standard wellbore drilling bit. Examples of suitable drillable materials are aluminium, brass, plastics and fibre reinforced polymers.

A guide device according to the present invention positions the tip of the device near to and/or above a centre of the wellbore, to avoid impact obstructions such as ledges formed at the boundary between harder and softer formations. The device is a passive device, in some embodiments requiring no particular angular orientation of the tool string or guide device or monitoring or interactive control of positioning. The tool string may be provided without wheels, rollers, skids or other devices used to carry the tool string down the wellbore, and/or without orientation devices used to orient the tool string in a particular angular orientation within the wellbore. Where a tool string is provided with an orientation device to set the tool string at a known angular orientation in the wellbore, the device may be configured with a hinge joint to allow the tip of the guide device to be located at or above the wellbore centreline. The configuration of the device including the centraliser located below the flexible joint with respect to a vertical wellbore ensures the tip is located away from the wellbore wall, with the mandrel being angled upwards from the tool string when located on the low side of the wellbore in deviated wells, increasing the chance of locating and entering a smaller diameter bore section below a larger diameter bore section. Positioning of the tip of the device is not achieved as the result of axial impacts with wellbore obstructions. Axial impacts are avoided, with the guide device skiing over obstacles in the wellbore to assist in maintaining momentum of the tool string as it descends down the wellbore. Further advantages of a guide device according to the present inventive include a device that is simple to manufacture and maintain and which comprises a small number of parts, a minimum number of metallic components, and a device that is easy to manipulate being lightweight, and which can be drilled through should the device be lost downhole.

Unless the context clearly requires otherwise, throughout the description and the claims, the words "comprise", "comprising", and the like, are to be construed in an inclusive sense as opposed to an exclusive or exhaustive sense, that is to say, in the sense of "including, but not limited to".

Where in the foregoing description, reference has been made to specific components or integers of the invention having known equivalents, then such equivalents are herein incorporated as if individually set forth.

Although this invention has been described by way of example and with reference to possible embodiments thereof, it is to be understood that modifications or improvements may be made thereto without departing from the spirit or scope of the appended claims.

REFERENCE NUMERALS APPEARING IN THE FIGURES

1. Logging tool
5. Washout section of the wellbore
6. Gauge section of the wellbore
10. Wellbore
11. Ledge
12. Hard rock
13. Soft formation
14. Casing
15. Casing shoe
20. Guide device
21. Coupling
22. Mandrel
23. Flex or articulating joint
24. Tip
25. Centraliser

The invention claimed is:

1. A guide device for a tool string to guide the tool string down a wellbore, the guide device comprising:

a coupling to connect the guide device to an end of a tool string, a mandrel and a tip at a leading end of the mandrel, a joint between the mandrel and the coupling allowing angular displacement of the mandrel relative to the tool string so that the tip can displace from a longitudinal axis of the tool string wherein the joint allows continuous angular displacement of the mandrel in all directions so that the tip can freely displace from the longitudinal axis of the tool string at any time; and a passive centralising device attached to the mandrel at a longitudinal position between the joint and the tip so that the guide device is configured to orient the mandrel to continuously maintain the tip at or above a centreline of the wellbore as the guide device descends the wellbore.

2. The guide device as claimed in claim 1, wherein the joint permanently transmits axial loads of 20,000 pounds.

3. The guide device as claimed in claim 1, wherein the joint is biased to a central position, so that the longitudinal axes of the mandrel and tool string are aligned when no lateral force is provided to the mandrel.

4. The guide device as claimed in claim 1, wherein the joint is a universal joint or a ball and socket joint, or comprises an elastomeric member, or comprises a swivel joint in combination with a hinge.

5. The guide device as claimed in claim 1, wherein the mandrel is positively buoyant or has neutral buoyancy in drilling mud.

6. The guide device as claimed in claim 1, wherein the centralising device is a bow-spring centraliser and the mandrel, the tip and bow-spring centraliser weigh less than a maximum weight that the bow spring centraliser can support when immersed in well bore fluid.

7. The guide device as claimed in claim 1, wherein when immersed in well bore fluid with a density of at least 1.3 g/cc the mandrel weighs less than 5 kg, or less than 10 kg, or less than 15 kg.

8. The guide device as claimed in claim 1, wherein the mandrel is constructed from a material with a density of less than 3 g/cc, or wherein the mandrel has an average density of less than 3 g/cc.

9. The guide device as claimed in claim 1, wherein the centralising device is located on the mandrel nearer to the tip than the joint, and/or the centralising device is located at or near to the tip end of the mandrel.

10. The guide device as claimed in claim 1, wherein the centralising device is mountable to the mandrel at a plurality of longitudinal positions.

11. The guide device as claimed in claim 1, wherein the centralising device has sprung standoffs.

12. The guide device as claimed in claim 1, wherein the centralising device is a bow-spring centraliser.

13. The guide device as claimed in claim 12, wherein the centralising device comprises three or more bow springs spaced equi-distant apart around a circumference of the mandrel.

14. The guide device as claimed in claim 1, wherein the centralising device has fixed stand offs.

15. The guide device as claimed in claim 1, wherein the centralising device has a minimum outer diameter less than the diameter of a gauge section of the well bore.

16. The guide device as claimed in claim 1, wherein the mandrel is made from a drillable material.

* * * * *